US005403380A

United States Patent [19]

Talonen et al.

[11] Patent Number: 5,403,380

[45] Date of Patent: Apr. 4, 1995

[54] METHOD FOR PRODUCING EASILY VOLATILE METALS, SUCH AS ZINC, LEAD, MERCURY AND CADMIUM, OF SULFIDIC RAW MATERIALS

[75] Inventors: Timo T. Talonen, Pori; Heikki J. Eerola, Ulvila, both of Finland

[73] Assignee: Outokumpu Research Oy, Pori, Finland

[21] Appl. No.: 61,207

[22] Filed: May 13, 1993

[30] Foreign Application Priority Data

May 20, 1992 [FI] Finland ..... 922301

[51] Int. Cl.[6] ..... C22B 19/04

[52] U.S. Cl. ..... 75/634; 75/10.3; 75/637; 75/658; 75/669; 75/670; 75/696

[58] Field of Search ..... 75/10.29, 10.3, 658, 75/696, 669, 670, 634, 637

[56] References Cited

U.S. PATENT DOCUMENTS

| | | | |
|---|---|---|---|
| 3,463,630 | 8/1969 | Todd | 75/23 |
| 4,334,918 | 6/1982 | Warner | 75/696 |
| 4,372,780 | 2/1983 | Madelin | 75/10.29 |

*Primary Examiner*—Melvyn J. Andrews
*Attorney, Agent, or Firm*—Brooks Haidt Haffner & Delahunty

[57] ABSTRACT

The invention relates to a method for producing zinc, cadmium, lead and other easily volatile metals from sulfidic raw materials in a pyrometallurgical process. In the method, zinc sulfide concentrate is fed into molten copper in atmospheric conditions, at a temperature of 1,450°-1,800° C., so that the zinc, lead and cadmium are volatilized, and the iron and copper remain in the molten metal or in the metal sulfide matte created in the furnace.

11 Claims, 3 Drawing Sheets

Figure 1:
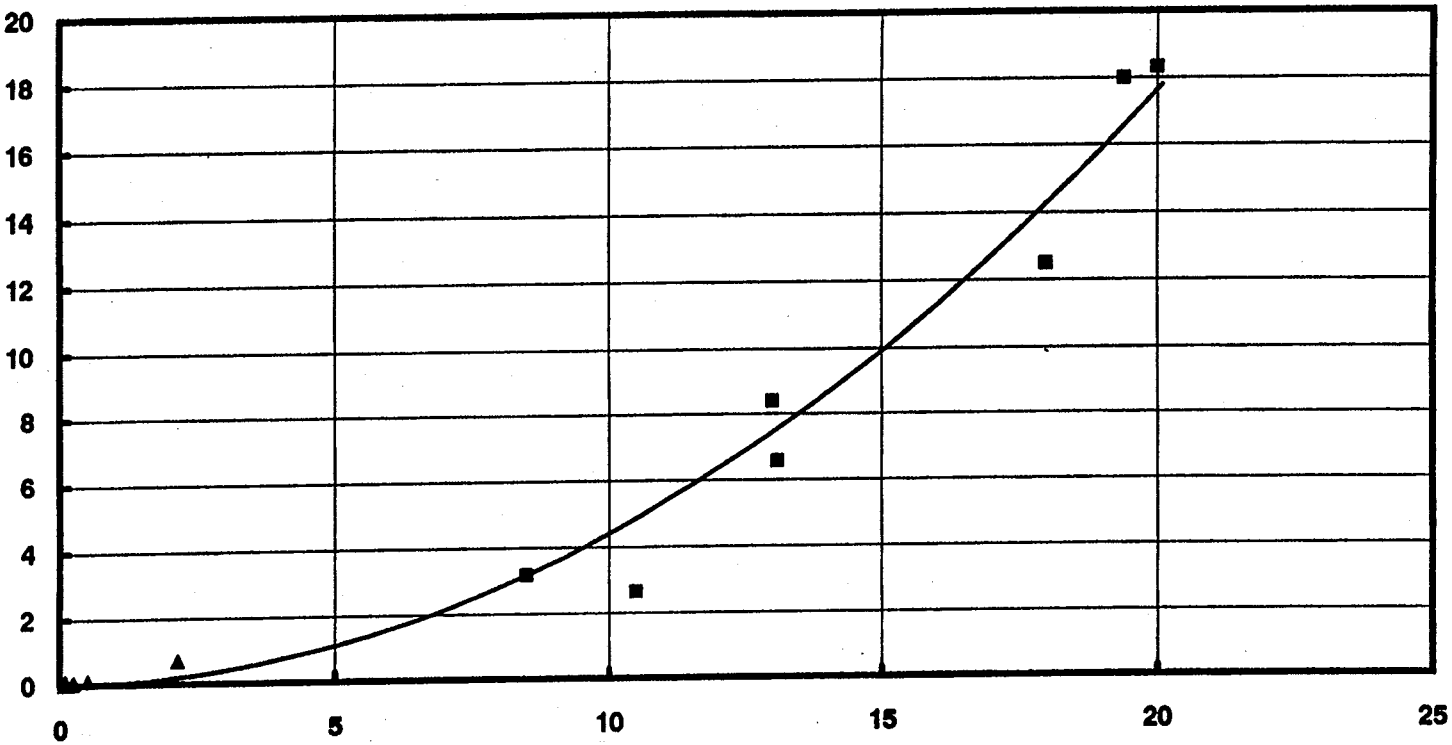

METHOD FOR PRODUCING EASILY VOLATILE METALS, SUCH AS ZINC, LEAD, MERCURY AND CADMIUM, OF SULFIDIC RAW MATERIALS

The present invention relates to a method for producing zinc, cadmium, lead and other easily volatile metals of sulfidic raw materials in a pyrometallurgical process.

In pyrometallurgical zinc production, the prevailing methods have been those where sulfide ore or concentrate is first rendered into oxidic form by calcination, whereafter zinc and other precious metals are reduced with some carbonaceous material.

The U.S. Pat. No. 2,598,745 describes the reduction of an oxidic zinciferous ore containing copper, silver and/or gold in a submerged arc furnace at temperatures below 1,450° C. into matte, essentially zinc-free slag and metallic zinc vapor. According to the patent, the feed contains sulfide sulfur, or sulfurous material is fed into the furnace to such extent that there is created a matte to which is dissolved at least part of the iron as well as the copper, silver and gold. The resulting zinc vapor is condensed into a massive molten metal.

The U.S. Pat. No. 3,094,411 describes a method where a mixture of a zinc oxide bearing material and fine coal is poured into a melt of copper or copper alloy and submerged by means of a suitable equipment. The melt is kept at a temperature between 1,900°-2,200° F. (about 1,038°-1,204° C.), so that the zinc is reduced, and an alloying of the copper and zinc results. The unreducible slag is allowed to rise to the surface and is skimmed off. Thereafter the alloy is heated at atmospheric pressure or reduced pressure, under reducing or neutral conditions, so that the greater portion of the zinc is volatilized, condensed and recovered as massive metal.

The U.S. Pat. No. 3,892,559 describes a process where an essentially copper and zinc bearing concentrate, ore or calcine is injected, together with flux, fuel and an oxygen bearing gas into a bath of molten slag. The formed copper matte is separated from the slag in a separate settling furnace. The zinc metal, volatile sulfide or sulphur are volatilized and recovered later. According to the method, the amount of the oxygen bearing gas is restricted, so that the copper contained in the bath is not oxidized further than to $Cu_2S$. The copper matte gathers the precious metals.

The U.S. Pat. No. 3,463,630 describes a method where zinc, lead and/or cadmium are produced by means of a reaction between the sulfides of the said metals and metallic copper. Mineral sulfide is reduced by molten copper in a metal extractor, and the result is sulfide matte ($Cu_2S$) and an alloy of the metal being reduced and copper. The matte is conducted to a converter, where it is converted with oxygen or air into copper and sulfur dioxide. The copper is returned to the metal extractor.

From the metal extractor the metal alloy is conducted into an evaporator, where the easily volatile metals are evaporated from the molten copper alloy, and the resulting copper goes to a converter or a metal extractor. The evaporated metals are condensed in a condenser or fractionally distilled; zinc and cadmium are condensed separately.

The alloy may contain 1-17% zinc. An optimum temperature for the alloy when let out of the metal extractor is 1,200° C. The alloy can be produced up to the temperature 1,450° C. A rise in the temperature increases the sulfur content and decreases the zinc content of the alloy.

A phenomenon reducing the zinc yield is the volatilizing of zinc from the metal extractor in gaseous form. When the amount of zinc dissolved in the matte is attempted to be restricted by raising the temperature, the amount of zinc volatilized into the gas is increased. A similar effect is caused by sulfur dioxide gas added from the converter to the metal extractor, or exhaust gas resulting from the burning of fuel.

The GB patent application 2,048,309 describes a method for recovering a non-ferrous metals from its sulfide ores. In this method, the ore is dissolved or melted into a molten sulfide carrier composition, such as copper matte, which circulates in the metal extraction circuit. Thereafter the composition is contacted with oxygen and oxidized for instance in a converter, so that at least part of the ore is oxidized. The carrier composition absorbs the created heat and transmits it to endothermic sites in the circuit.

The metal to be extracted can be zinc or a molten sulfidic copper matte composition, and the oxidation converts the copper sulfide of the matte to copper, which then is able to reduce the zinc sulfide ore directly into zinc, or the composition contains iron sulfide, and the iron sulfide is converted to iron oxide, which can, after further processing, reduce the zinc sulfide ore into zinc, the said further processing including the reduction of iron oxide into metallic iron.

It is characteristic of the above described method that the process comprises a reduced pressure vessel, where the volatile material is recovered as metal or sulfide in question, or impurities are recovered by means of suction. The metal to be recovered can also be tin, in which case tin sulfide is recovered as a volatile material. The molten composition is made to circulate, at least partly, by means of the said suction. The composition can also be made to circulate by injecting gas therein, in order to produce localised decrease in the density of the composition. Because the process is realized at reduced pressure, the process temperature is in the region 1,150°-1,350° C. The heat required by the endothermic reactions taking place in the contactor and reduced pressure vessel is obtained by circulating in the converter an excessive amount of sulfide matte, which is heated in the converter or can further be heated by means of burners.

The present invention relates to the production of zinc pyrometallurgically, where zinc is volatilized directly from zinc concentrate in an electric furnace at atmospheric pressure, while the temperature during the presence of molten copper is 1,450°-1800° C., and zinc is recovered as molten metal by condensing from the exhaust gases of the electric furnace. By using this method, there are also recovered other valuable metals usually contained in the concentrate, i.e. lead, cadmium, copper, silver, gold and mercury. The essential novel features of the invention are apparent from the appended patent claims.

Figure 2:
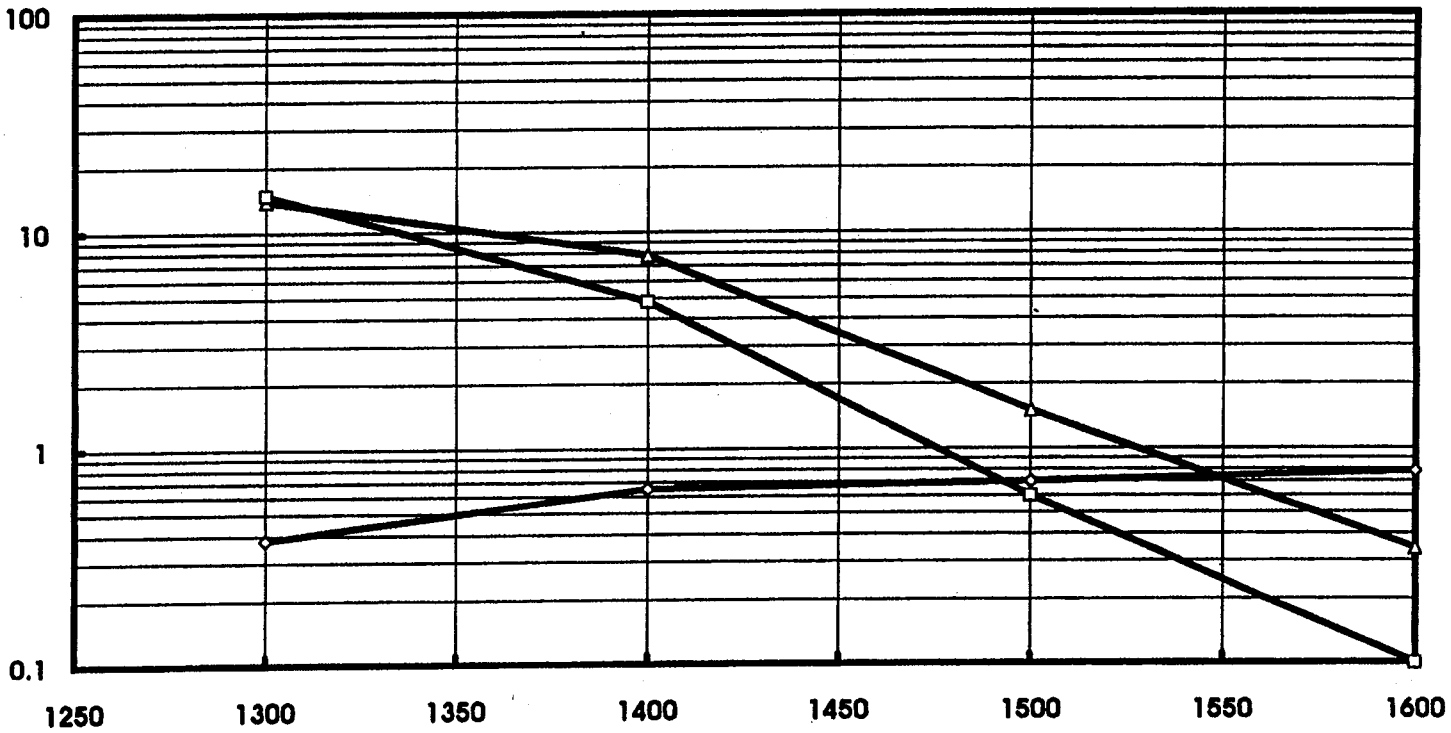

The invention is also illustrated with reference to the appended drawings, where FIG. 1 is a graph illustrating the proportion of the lead contents in the slag and matte as a function of the copper content of the slag, and FIG. 2 illustrates the zinc content of the metal and matte, and the sulfur content of the metal as a function of the temperature.

Figure 3:
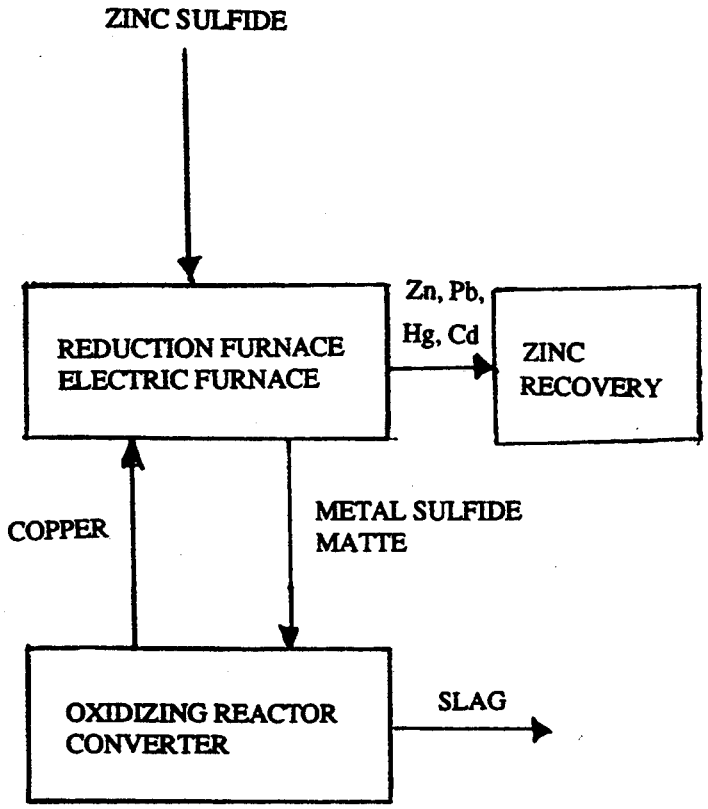

FIG. 3 is a schematic illustration of apparatus suitable for performing the method of the invention.

The method makes use of the capacity of copper to bind sulfur more readily than zinc or lead, which capacity was already described by Fournet in 1833. Cadmium, mercury and silver behave in similar fashion, too. The sulfides of the said metals are made to react at a raised temperature with the molten copper present in the furnace, and the following reactions take place:

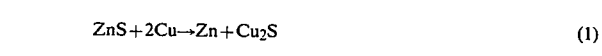

$$ZnS+2Cu \rightarrow Zn+Cu_2S \quad (1)$$

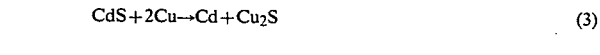

$$PbS+2Cu \rightarrow Pb+Cu_2S \quad (2)$$

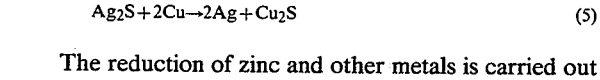

$$CdS+2Cu \rightarrow Cd+Cu_2S \quad (3)$$

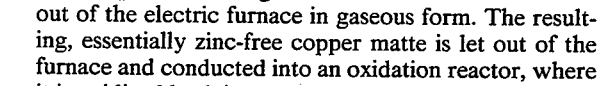

$$HgS+2Cu \rightarrow Hg+Cu_2S \quad (4)$$

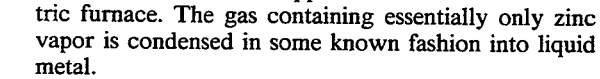

$$Ag_2S+2Cu \rightarrow 2Ag+Cu_2S \quad (5)$$

The reduction of zinc and other metals is carried out at a temperature so high that the volatile metals are let out of the electric furnace in gaseous form. The resulting, essentially zinc-free copper matte is let out of the furnace and conducted into an oxidation reactor, where it is oxidized back into copper and returned to the electric furnace. The gas containing essentially only zinc vapor is condensed in some known fashion into liquid metal.

Owing to the high temperature, the amount of zinc dissolved into the copper is small. However, it is of no importance in this method, because copper is not essentially recovered from the furnace, but it is used up in reactions with the metal sulfides to be reduced.

The lower limit of the melts in an electric furnace is determined according to the required zinc yield. In performed laboratory experiments, the recovery into gas at 1,300° C., after the zinc content of the copper present in the furnace had reached its saturation point, was about 55%, at 1,400° C. respectively about 84% and at 1,500° C. over 99%. Consequently an acceptable recovery of zinc requires a minimum temperature of 1,450° C. of the melts in the electric furnace.

The upper limit of the melts is determined by the durability of the materials of the furnace structures. In practice the temperature resistance of the lining materials limits the process temperature to below 1,800° C.

The sulfur content of produced zinc is raised along with the temperature. In the experiments that were carried out, the sulfur content of the zinc recovered from the gas was 0,004% at 1,400° C. and 0,02% at 1,500° C.

Lead is volatilized from melts remarkably worse than zinc, because it has a lower vapor pressure. Particularly in mixed concentrates containing lead in addition to zinc, the proportion of the lead and zinc contents may be so great, that irrespective of the high lead content of the alloy, the partial pressure of lead is not sufficient for evaporating the lead obtained along with the raw material. Particularly at low temperatures, large amounts of lead are accumulated in the electric furnace as dissolved into copper. Above the melting point of copper, lead and copper have complete miscibility.

In order to maintain the lead content in the matte and metal present in the electric furnace low at moderate running temperatures, the volatilization of lead can be intensified by purging the molten metal present in the furnace by means of some inert gas, for instance nitrogen, blown therein. Thus the lead can be volatilized from the melt along with a carrier gas with a lower vapor pressure. Zinc gas also functions as a carrier gas for lead. The amount of required purging gas depends on the quantities of lead and zinc contained in the concentrate.

The use of a purging gas also is advantageous when treating a concentrate containing zinc only, because there is then achieved, already at a lower temperature, a zinc yield which would otherwise require the use of a higher temperature.

In a continuous process, where into an electric furnace there is continuously fed copper and continuously injected sulfide concentrate, the zinc contents of matte and copper are higher than in a batch process. In a continuous process, the matte can be let out of the electric furnace through a special settling and volatilizing zone, where the copper droplets contained in the matte are recovered, and the lead and zinc contents of the matte are lowered by volatilizing with an inert gas.

When the above mentioned scrubbing gas is employed, it is advantageous also to use it as the carrier gas, whereby the ore or concentrate is injected into the molten copper bath present in the electric furnace. An increase in the amount of gas to be injected cuts the lead and zinc contents of the sulfide matte and copper, but on the other hand makes the recovery of metals from the gas more difficult by diluting it.

A conventional method for producing zinc pyrometallurgically is to reduce an oxidic or oxidic calcinated ore or concentrate with carbon or some carbonaceous substance. In these processes zinc is volatilized and let out of the reactor in gaseous form along with a carbon monoxide or carbon dioxide bearing gas. Condensing zinc from such a gas is problematic, because while cooling, zinc tends to be oxidized owing to the effect of carbon dioxide:

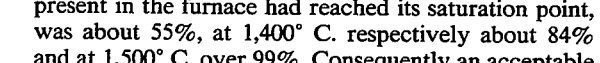

$$Zn_{(g)}+CO2_{(g)} \rightarrow ZnO_{(s)}+CO_{(g)} \quad (6)$$

This problem is solved by cooling the gas so rapidly that the oxidation according to reaction (6) does not have time to take place. The rapid cooling can be carried out for instance by means of molten zinc injected into the gas, or advantageously by means of molten lead, in which case the condensing zinc is dissolved into the lead, and its activity is decreased. At the second stage, zinc can be recovered from lead by cooling.

In the method of the present invention, zinc is let out of the reactor solely as zinc vapor, which apart from zinc essentially contains only other easily volatile metals that are reduced by copper. If an inert carrier gas such as nitrogen is used while feeding the material into the reactor, the gas let out of the reactor also contains the same gas, but it does not contain gaseous compounds that are essentially oxygen bearing. Therefore the problem of zinc oxidizing, which is common in conventional pyrometallurgical processes, does not exist in this method. Zinc and other volatilized metals can be recovered by conventional means, by cooling the gases so that they are condensed.

In pyrometallurgical zinc processes, the crude zinc to be produced contains lead and cadmium, among others. Crude zinc is often cleaned by recovering the said gangues by fractional distillation. In the New Jersey method, crude zinc is distilled in two successive columns, where lead, zinc and cadmium, among others, are separated.

Energy consumption in the fractional distillation of zinc is high, about 7 GJ/t zinc. The major part of the energy goes to the evaporation of zinc in the distillation columns.

In the method of the present invention, zinc exists essentially as zinc vapor alone, or in vaporized form mixed with the inert carrier gas, and therefore it can be conducted to the distillation column directly from the reactor, without first condensing it into liquid. Reoxidation of zinc does not take place, because the distillation columns do not contain oxygen or oxidizing compounds. Thus the major part of the energy that is normally required by the distillation process can be saved.

When in the experiments that were carried out the sulfidic zinc material was fed into the copper bath in the reduction reactor by injecting with an inert carrier gas, the sulfur content and also gangue contents of the zinc condensed of the reactor exhaust gases were higher than in experiments that were carried out without a carrier gas. This is partly due to the fact that the carrier gas seizes unreacted metal sulfides along, which sulfides are then carried along with the gas into the zinc condensing reactor. An increase in the amount of gas discharged from the reactor also increases the amounts of sulfur and metal sulfides volatilized and emitted as gases from the raw material and the matte.

Owing to air leakages, oxygen may be conducted into the electric furnace or into gas pipes, which oxygen, together with metals, forms metal oxides with a high melting temperature.

In the zinc condensing reactor, the said impurities form solid dross or a separate molten layer on top of the zinc. It can be removed in a known fashion and returned to the reduction reactor or to the converter.

If the gas is conducted from the reduction furnace directly to the distillation column, the above mentioned impurities may cause blocking in the trays of the distillation column, or otherwise interfere with the operation of the column. In order to avoid difficulties, the gas can be cleaned by injecting, prior to conducting into the distillation column, with a molten metal essentially containing lead and/or zinc. The temperature in the injection chamber is adjusted to be so high that the zinc contained in the gas is essentially not condensed off the gas, but instead the above mentioned impurities, as well as part of the lead contained in the gas, are joined in the lead and/or zinc flow circulating in the washing.

Part of the removed impurities form solid dross on the surface of the molten metal contained in the chamber, and it is removed in a known fashion. Part is dissolved in the molten metal or forms on the surface thereof a separate molten layer which is insoluble or only weakly soluble to metal. From the washing reactor, the cleaned gas is conducted directly into the distillation column, where the lead, zinc, cadmium and other volatile metals contained therein are separated.

By raising the temperature of the molten metal contained in the chamber, the amounts of zinc and lead that in the washing zone are transferred from gas to melt can be reduced. Consequently their yield from the distillation column is increased. This is advantageous, because the metals recovered from distillation are purer than those recovered from the above described washing reactor. The metal temperature can be raised up to the temperature of the gas entering the washing reactor. The lower limit of the temperature is the boiling point of zinc, i.e. about 905° C.

The iron and copper sulfide contained in the concentrate do not react in the electric furnace, but they are only dissolved in the matte phase. Pyrite loses its labile sulfur, which reacts with copper resulting in copper sulfide.

Thus the copper contained in the concentrate is gathered in the copper circulating in the process. It can be removed of circulation and recovered either as metal after the converter, or as matte from the electric furnace.

The iron contained in the concentrate is oxidized in the converter. Together with suitable fluxes to be fed in the converter, for instance silicon oxide, it forms a molten slag which is removed as waste.

Normally zinc concentrate also contains small amounts of precious metals. In the temperatures prevailing in the electric furnace, the vapor pressure of silver is generally sufficient for evaporating all silver coming along with the concentrate. However, its dissolution into large quantities of metal and matte reduces the activity to such extent that a remarkable amount of the silver remains unevaporated. The vapor pressure of gold is so low that essentially all gold is dissolved in the metal alloy and matte.

In the article by S. Sinha, H. Sohn and M. Nagamori: *Metallurgical Transactions B,* March 1985, vol. 16B it is said that according to measurements, at 1,400 K. the gold content in copper which is in equilibrium with sulfide matte is about 100-fold compared to the content in the matte. A raise in the temperature raises the content in copper and lowers it in matte. According to the same study, the silver content in copper at 1,400 K. is about 2.1-fold compared to the content in copper sulfide matte.

In the method of the present invention, it is advantageous to let the above mentioned precious metals to be concentrated to the copper and matte present in an electric furnace, and from time to time let a small amount of metal alloy out of the furnace, from which alloy the precious metals then are recovered in a known fashion, for instance in some copper production process.

Sometimes it may turn advantageous to continuously let a small metal alloy flow out of the furnace in order to recover the precious metals contained therein and to remove possible impurities gathered in the metals from the furnace. This is advantageous if the precious metal content in the raw material is exceptionally high, or the concentrate contains large amounts of harmful impurities. One such harmful impurity concentrated into copper is arsenic.

Because the raw material often contains small amounts of copper, the removal of the metal alloy from the circulation does not necessarily cause a deficit in the copper amount circulating in the process, but the copper content of the concentrate can thus be removed of the process and utilized.

The precious metals dissolved in the matte go, along with the matte, to a converting process, where an essential amount of precious metals is known to be transferred to copper and back to the electric furnace therealong.

In some cases it may be advantageous to remove sulfide matte from the process instead of the metal alloy, in which case the above mentioned metals and impurities are then recovered from the sulfide matte.

It is advantageous for the operation of this process that oxygen does not exist in the electric furnace in such compounds where it could get into the gas, to hinder the condensing and distillation of zinc. Although the iron contained in the feed can bind small amounts of oxygen by oxidizing into the slag as iron oxide, it is advantageous that the copper obtained from the converter contains as little oxygen as possible. On the other hand, copper does not have to be as sulfurless as what is customary in conventional copper processes. Advantageously the converter blasting is interrupted before all matte is disappeared from the converter and the oxygen content of copper begins to grow.

In the experiments that were carried out, copper matte was converted with air blasting, so that the created blister copper was in equilibrium with the sulfide matte at about 1,300° C. The oxygen content of the resulting blister copper was 0.07% in average, and its sulfur content respectively about 1%.

Sulfide matte to be removed from an electric furnace can be converted in a known fashion, for instance in a Pierce-Smith converter, or the converter process is advantageously continuous, so that into the process there is continuously fed sulfide matte from the electric furnace, and metallic copper is continuously removed from the process to the electric furnace. The amount of matte to be removed from the electric furnace is nearly stoichiometric with respect to the amount of sulfide fed into the furnace, because the matte does not have to be circulated in order to maintain endothermic reactions. In our method, the heat developed in the converter can be utilized for several purposes, for instance in treating jarosite waste from old zinc plants, so that the waste is turned into ecological slag.

The copper content of the slag created in the converter is so high, over 6% at its lowest, that it must be cut in a slag cleaning process prior to removal as waste. By using calcium ferrite slag instead of fayalite slag, the copper content of the converter slag can be reduced.

Known methods can be used in slag cleaning, for instance reduction with a carbonaceous reductant in an electric furnace. The copper or copper bearing matte obtained from this process can be fed into a zinc recovery electric furnace or a converter.

Sulfide matte can be oxidized in a converter to a more complete degree, so that only blister copper and slag remain in the reactor at the final stage of converting. The oxygen content of the resulting blister copper is higher and sulfur content lower than in the former case; the copper content of the slag is higher. Prior to returning the copper into the zinc recovery electric furnace, its oxygen content can be reduced in a known anode furnace process, where blister copper is reduced with a carbonaceous reductant.

If the raw material essentially contains lead, the lead contents of the matte and copper grow to be remarkable in a stationary running situation, owing to the low vapor pressure of lead. In pilot-scale experiments, where a concentrate with a lead content of roughly 14% was treated, the lead content of the matte was about 4% at highest, and the lead content of the metal was about 14%. With respect to the lead yield, a noteworthy factor is the lead content of the matte, because matte is recovered from the furnace into the converting process.

A good yield of lead requires that the converting process and slag cleaning are controlled, so that as much of the lead dissolved in the matte as possible returns to the electric furnace along with the copper. This is possible for instance by using calcium ferrite slag in the converting process.

The invention is illustrated by means of FIG. 1, which is a graph representing the proportion of the lead contents of slag and matte in the converting of lead bearing copper sulfide matte and in the cleaning of slag.

The distribution of lead in the converting depends on the degree of oxidation. According to the measurements that were carried out, the lead contents in the converter slag and copper occur, according to FIG. 1, so that with a low copper content of the slag, the lead content in the copper is high compared to its content in the slag, and vice versa.

In order to make the loss of lead into waste slag as low as possible, it is advantageous to control the converting process so that the copper content of the created slag is as low as possible. This is achieved in a situation where both the created copper and slag are in equilibrium with the sulfide matte.

The lead content of the converter slag is further reduced to a minimum by subjecting the slag to an effective reduction in a slag cleaning process, so that the copper content of the slag also is brought low. In the above mentioned experiments, the lead content of waste slag was about 0.3% at its lowest.

The invention is further explained with reference to the appended examples; the examples with a temperature below 1,450° C. are reference examples.

EXAMPLE 1

800 g electrolyte copper and 500 g zinc concentrate were inserted in a crucible and heated in an induction furnace up to 1,300° C. The developed gas was recovered and cooled down in order to condense zinc therefrom. After the experiment, the crucible and the ingredients contained therein were cooled and analyzed. The results are given in the table below.

| | sulfur % by weight | zinc % by weight | copper % by weight |
|---|---|---|---|
| concentrate | 33.8 | 46 | 0.8 |
| metal in crucible | 0.38 | 13.9 | |
| sulfide matte in crucible | 23.1 | 14.9 | 54.1 |

When the same experiment was repeated at 1,400° C., the following results were obtained:

| | sulfur % by weight | zinc % by weight | copper % by weight |
|---|---|---|---|
| concentrate | 33.8 | 46 | 0.8 |
| metal in crucible | 0.65 | 7.8 | |
| sulfide matte in crucible | 22.2 | 4.8 | 66 |
| metal condensed from gas | 0.001 | 99 | |

EXAMPLE 2

The experiment described in the above example was repeated, with the difference that the crucible was heated up to 1,500° C. The following results were obtained:

| | sulfur % by weight | zinc % by weight | lead % by weight |
|---|---|---|---|
| concentrate | 31.2 | 53.3 | 2.3 |
| metal | 1.1 | 1.6 | 2.3 |
| sulfide matte | 19.8 | 0.96 | 0.59 |
| metal condensed from gas | 0.01 | 99 | |

EXAMPLE 3

The experiment of example 1 was repeated, with the difference that the crucible was heated up to 1,600° C. The following results were obtained:

| | sulfur % by weight | zinc % by weight | copper % by weight |
|---|---|---|---|
| concentrate | 33.8 | 46 | 0.8 |
| metal in crucible | 0.78 | 0.34 | |
| sulfide matte in crucible | 20.9 | 0.1 | |
| metal condensed from gas | 0.01 | | |

The zinc content of metal and matte, as well as the sulfur content of metal, are illustrated in FIG. 2 as a function of the temperature.

EXAMPLE 4

Into an pilot electric furnace there was fed 300 kg copper in addition to the 200 kg left over from the previous experiment. The copper was melted and the temperature was adjusted to 1,380° C. Thereafter a total amount of 195 kg of concentrate containing zinc and lead was fed inside the copper at a feeding rate of 57 kg/h by means of an injection lance, and the employed carrier gas was nitrogen gas, 87 l/kg concentrate. After the injection, the melts created in the furnace were analyzed. The results are given in the table below:

| | zinc % by weight | sulfur % by weight |
|---|---|---|
| concentrate | 29.3 | 14.2 |
| metal | 3.75 | 8.3 |
| sulfide matte | 1.7 | 3.0 |

EXAMPLE 5

The experiment was repeated in similar fashion as in example 4, but an additional amount of 400 kg copper was melted, and the temperature was adjusted to 1,530° C. A total amount of 210 kg concentrate was injected at a feeding rate of 41 kg/h, and the employed carrier gas was nitrogen, about 200 l/kg concentrate. The results are given in the table below:

| | zinc % by weight | lead % by weight |
|---|---|---|
| concentrate | 29.3 | 14.2 |
| metal | 1.1 | 5 |
| sulfide matte | 0.25 | 1.75 |

EXAMPLE 6

Into an pilot electric furnace there was fed 300 kg copper, and the temperature was adjusted to 1,570° C. A total amount of 320 kg concentrate was injected at a feeding rate of 60 kg/h, and the carrier gas was nitrogen, about 132 l/kg concentrate. The results are given below:

| | zinc % by weight | lead % by weight |
|---|---|---|
| concentrate | 29.3 | 14.2 |
| metal | 0.71 | 9.4 |
| sulfide matte | 0.28 | 2.8 |

We claim:

1. A pyrometallurgical method for recovering zinc and one or more of the easily volatile metals lead, cadmium and mercury from zinc sulfide concentrate that contains one or more of said easily volatile metals, wherein any gold and/or silver present in the zinc sulfide concentrate are separated from the easily volatile metals, comprising: feeding zinc sulfide concentrate and metallic copper into a reduction furnace operating at atmospheric pressure for causing molten metallic copper to convert the zinc, lead, cadmium and/or mercury present in the zinc sulfide concentrate into metallic form; operating the reduction furnace at a temperature sufficiently high to recover zinc, lead, cadmium and/or mercury from the reduction furnace in gaseous metal form while leaving copper and any gold and/or silver in molten form as metal or metal sulfide matte in the furnace; recovering gaseous metals from the furnace and condensing said gaseous metals; circulating the matte from the reduction furnace to an oxidizing reactor to convert copper sulfide in said matte back to metallic copper and conducting such metallic copper from the oxidizing reactor back to the reduction furnace.

2. The method of claim 1 wherein the temperature in the reduction furnace is in the range of 1450° to 1800° C.

3. The method of claim 1 including injecting the zinc sulfide concentrate into copper in the reduction furnace by means of a carrier gas, wherein said copper is in a molten state.

4. The method of claim 1 including purging metal in the reduction furnace by blowing an inert gas into the metal while said metal is in a molten state.

5. The method of claim 1 including purging the sulfide matte in the reduction furnace with an inert gas.

6. The method of claim 4 or 5 wherein the inert gas is nitrogen.

7. The method of claim 1 and including recovering an amount of sulfide matte which is stoichiometric with respect to the zinc sulfide concentrate from the reduction furnace to the oxidizing reactor.

8. The method of claim 1, including conducting the gaseous metals to a condensing reactor.

9. The method of claim 1, including conducting the gaseous metals to a distillation reactor.

10. The method of claim 9 and including injecting molten metal containing lead and/or zinc into the gaseous metals prior to conducting the gaseous metals to the distillation reactor.

11. The method of claim 1 including recovering gold and/or silver from the matte.

* * * * *